United States Patent [19]

Fischer et al.

[11] Patent Number: 4,790,245

[45] Date of Patent: Dec. 13, 1988

[54] SUPPORT ASSEMBLY FOR A CYLINDER GROOVE

[75] Inventors: Christian M. M. Fischer, Marktheidenfeld; Detlef F. Stork, Offstein, both of Fed. Rep. of Germany

[73] Assignee: Koenig & Bauer Aktiengesellschaft, Würzburg, Fed. Rep. of Germany

[21] Appl. No.: 131,659

[22] Filed: Dec. 11, 1987

[30] Foreign Application Priority Data

Dec. 24, 1986 [DE] Fed. Rep. of Germany ..... 3644501

[51] Int. Cl.[4] ..... B41F 27/12

[52] U.S. Cl. ..... 101/375; 101/415.1

[58] Field of Search ..... 101/378, 375, 415.1

[56] References Cited

U.S. PATENT DOCUMENTS

| | | | |
|---|---|---|---|
| 1,506,859 | 9/1924 | Owen | 101/415.1 |
| 1,545,791 | 7/1925 | Owen | 101/415.1 |
| 1,654,431 | 12/1927 | Pickup et al. | 101/415.1 X |

FOREIGN PATENT DOCUMENTS

| | | | |
|---|---|---|---|
| 3434642 | 9/1984 | Fed. Rep. of Germany . | |
| 3337111 | 10/1984 | Fed. Rep. of Germany | 101/415.1 |
| 3540581 | 5/1987 | Fed. Rep. of Germany | 101/415.1 |
| 150573 | 9/1981 | German Democratic Rep. | 101/415.1 |
| 364594 | 6/1930 | United Kingdom | 101/415.1 |

*Primary Examiner*—Clifford D. Crowder

*Attorney, Agent, or Firm*—Jones, Tullar & Cooper

[57] ABSTRACT

A support assembly for a cylinder groove in a plate or blanket cylinder of a rotary printing machine utilizes an elongated support bar. The support bar has an upper support surface and is secured either directly or indirectly to the bottom of the cylinder groove. The upper support surfaces of the support bar is placed in the cylinder groove generally between ends of the printing plate or blanket carried by the cylinder at a height which effectively presents a continuous cylinder surface to eliminate cylinder deflection oscillations.

9 Claims, 8 Drawing Sheets

SUPPORT ASSEMBLY FOR A CYLINDER GROOVE

FIELD OF THE INVENTION

The present invention is directed generally to a support assembly for a cylinder groove. More particularly, the present invention is directed to a support assembly for a cylinder groove of a printing plate or blanket cylinder. Most specifically, the present invention is directed to a support assembly for a cylinder groove of a printing plate or blanket cylinder of a rotary printing machine. The support assembly is provided with a fastening means which allows the support assembly to be either directly or indirectly secured to the bottom of the cylinder groove of the plate or blanket cylinder. The support assembly extends upwardly within the cylinder groove and has an upper surface which is positionable at the periphery of the plate or blanket cylinder. This support assembly thereby supports the impression cylinder or other cylinder that cooperates with the plate or blanket cylinder while this cooperating cylinder overlies the cylinder groove in the plate or blanket cylinder.

DESCRIPTION OF THE PRIOR ART

Many printing plate and blanket carrying cylinders used in rotary printing machines have one or more grooves on their peripheral surfaces. These grooves extend along the surface of the cylinder, generally parallel to the axis of the rotation of the cylinder and carry plate or blanket end engaging and tensioning means. The width of these plate or blanket cylinder surface grooves must be sufficient to allow relatively easy insertion and manipulation of the printing plate or blanket ends. It is this width that causes a loss of printing quality in rotary printing machines. As the printing plate or blanket cylinder rotates during normal printing operations, it is in contact with a cooperating cylinder such as, for example, an impression cylinder. When the impression cylinder rolls across the groove in the surface of the plate or blanket cylinder, there is a momentary reduction in the pressure between the cylinders. This pressure reduction or relief causes the impression cylinder to deflect slightly. This slight or momentary deflection occurs each time the impression cylinder rolls across the groove in the plate or blanket cylinder. There is thus set up a repeating deflection oscillation and this deflection oscillations leads to the formation of stripes on the printed products produced by the rotary printing machine.

One prior art assembly for use in counteracting the above-discussed deflection oscillations may be seen in German Pat. No. 3434642. This patent utilizes a cylinder having a plurality of rectangular recesses separated from each other by cross pieces. These cross pieces are shaped to conform to the curvature of the periphery of the plate or blanket cylinder and thus provide areas against which the impression cylinder can roll. Since the surface of the plate or blanket cylinder of this prior device now has these cross pieces, the deflection oscillations of the earlier assemblies are substantially diminished.

This prior art support assembly, as shown in the above-referenced German Pat. No. 3434642 does not use a cylinder wide groove. Hence the ends of the printing plate or blankets carried by this cylinder must be provided with slots or cut-out portions which can straddle the cross pieces. Only portions of the ends of the plates or blankets fit into, and are held by, the tensioning means carried beneath the surface of this prior art cylinder. When a printing plate or blanket has its ends modified by cutting out various spaced slits or slots, the stability of the plate or blanket is adversely affected. Particularly when the printing plate or blanket is being tensioned, this reduced stability is more apt to cause tearing of the ends of the plate or blanket. The insertion of the ends of the plate or blanket is also made more difficult by modifying the ends of the plate or blanket in a manner necessary to have the blanket or plate be usable with this prior art support assembly.

It will thus be seen that there is a need for a support assembly for a cylinder groove which will eliminate deflection oscillations while not compromising plate or blanket integrity or ease of insertion. The support assembly of the present invention provides such a device.

SUMMARY OF THE INVENTION

It is an object of the present invention to provide a support assembly for a cylinder groove.

Another object of the present invention is to provide a support assembly for a cylinder groove of a printing plate or blanket cylinder.

A further object of the present invention is to provide a support assembly for a cylinder groove of a printing plate or blanket cylinder of a rotary printing machine.

Yet another object of the present invention is to provide a support assembly for a cylinder groove which allow the use of printing plates or blankets whose ends need not have a special form.

Still a further object of the present invention is to provide a support assembly in a cylinder groove which does not hinder or interfere with insertion and tensioning of the plate or blanket ends.

Even yet another object of the present invention is to provide a support assembly in a cylinder groove in which the support assembly has an effective length substantially the same as that of the cylinder groove.

As will be discussed in detail in the description of the preferred embodiments which are set forth subsequently, the support assembly of the present invention includes one or more support elements which are receivable in the cylinder groove. The support element or elements provides a continuous upper support surface that is located within the cylinder groove at a height which is essentially the same as the periphery of the plate or blanket. Thus when the impression cylinder, or other similar cooperating cylinder, rolls across the upper surface of the support assembly there is no momentary reduction in pressure. If there is no pressure reduction or relief, there is no periodic deflection oscillation and printing quality is improved.

The support assembly of the present assembly is readily placed in, and removed from the cylinder groove. It can be removed to allow plate or blanket securement, tensioning, and removal in a generally conventional manner. Once the plate or blanket has been placed on the cylinder, the support assembly can be put into the groove and secured in place. This support assembly thus does not require that the ends of the printing plate or blanket be modified in any way. Thus the support assembly can be used without having a detrimental effect on the stability or durability of the printing plate or blanket.

The support assembly, in its several preferred embodiments of the present invention, extends essentially the complete length of the groove in the plate or blanket cylinder. This continuous length support surface distributes the pressure caused by the cooperating impression or other similar cylinder along the entire length of the cylinder. This insures an even contact pressure for better wear and less possibility of print quality reduction.

The support assembly for a cylinder groove in accordance with the present invention provides an assembly which effectively eliminates deflection oscillations while not hindering plate or blanket insertion or tensioning. It is thus a substantial improvement over prior art devices and provides a significant means for improving printing quality.

BRIEF DESCRIPTION OF THE DRAWINGS

While the novel features of the support assembly for a cylinder groove in accordance with the present invention are set forth with particularity in the appended claims, a full and complete understanding of the invention may be had by referring to the detailed description of the preferred embodiments are set forth subsequently and as illustrated in the accompanying drawings in which:

FIG. 18 is a top plan view of the fifth preferred embodiment of the support assembly.

DESCRIPTION OF THE PREFERRED EMBODIMENTS

Figure 1:
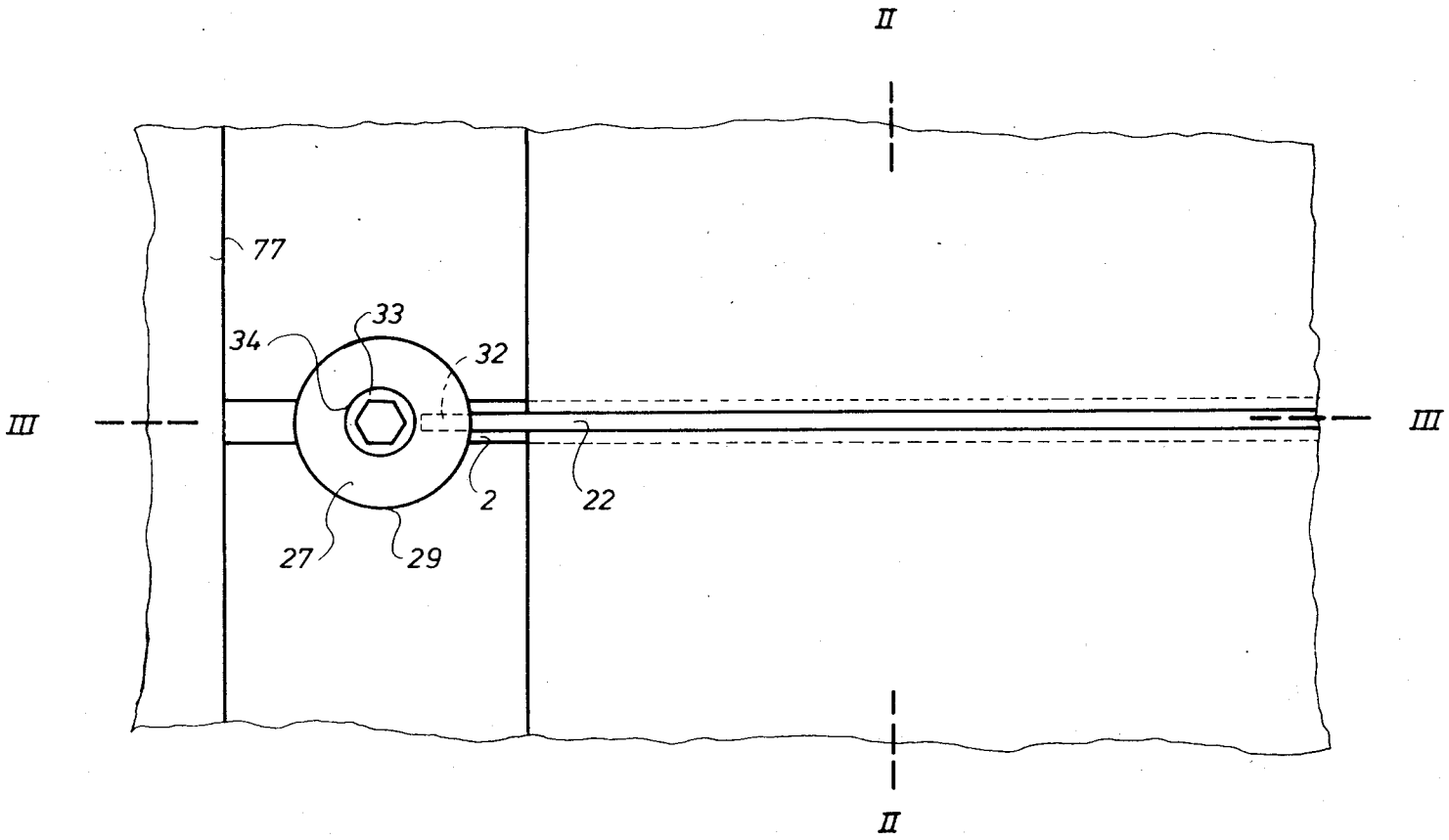
FIG. 1 is a top plan view of a first preferred embodiment of the support assembly in accordance with the present invention.
Figure 2:
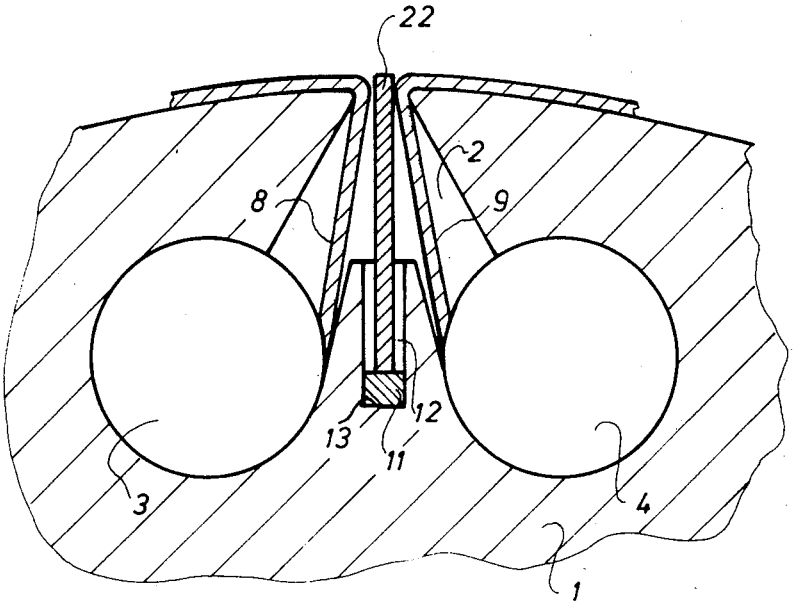
FIG. 2 is a sectional view taken along line II—II of FIG. 1.
Figure 3:
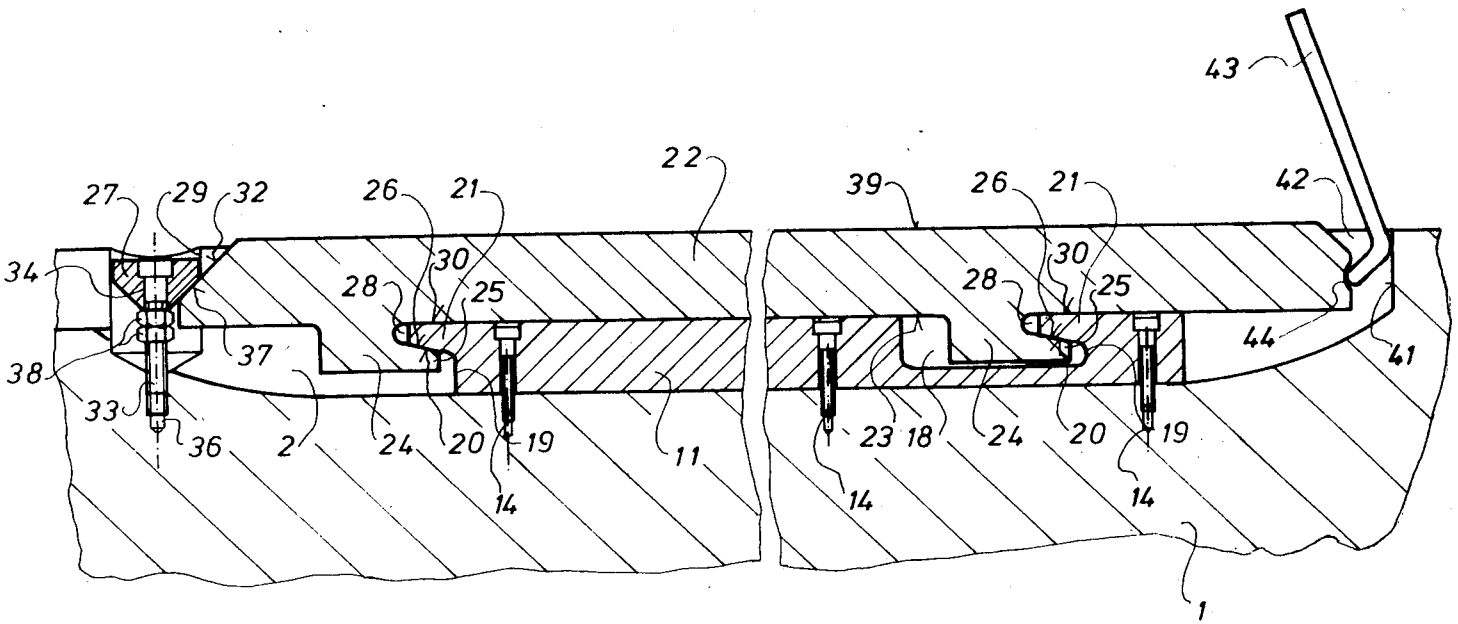
FIG. 3 is a sectional view taken along line III—III of FIG. 1.

Referring initially to FIGS. 1, 2 and 3, there is shown a first preferred embodiment of a support assembly for a cylinder groove in accordance with the present invention. A plate or blanket cylinder 1 has a groove 2 parallel to its axis. Plate or blanket tensioning elements 3 and 4 are arranged in groove 2 in a conventional manner. The tensioning elements 3 and 4 may, for example be designed as tensioning spindles 3 and 4 which each have a device (not shown) for accommodating a printing plate or blanket end 8 or 9. Between the tensioning spindles 8 and 4 in the middle of groove 2 a holding rail 11 is secured in a groove-long slot 12 by being fastened to the bottom 13 of the slot 12 by means of, for example, several fastening screws 14.

Figure 8:
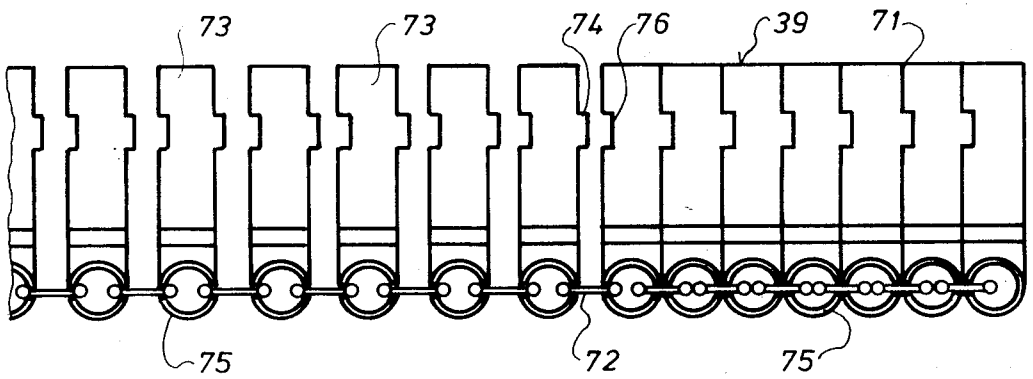
FIG. 8 is a side elevation view of a support bar portion of a fourth preferred embodiment of a support assembly in accordance with the present invention.

As may be seen most clearly in FIG. 8 holding rail II is almost as long as groove 2 and is provided with a plurality of depressions or recesses 18 which are spaced along its length at regular intervals. Each of these recesses 18 has a right side face 19 with each such side face 19 carrying a generally left facing projection 21. Each of these projections 21 extends into the open area formed by its corresponding depression or recess 18. A lower face portion 20 of each such projection 21 is inclined at an angle to the axis of rotation of cylinder 1 and forms a wedging surface.

A support bar 22 is attached to holding rail 11 and is interlocked with rail 11. This support bar 22 has a length which is generally about 9/10 of the length of groove 2. A plurality of generally downwardly extending vertical projections 24 are formed integrally with the support bar 22. Each of these projections is provided with a generally right facing key 25 that has an inclined upper surface. An open area or free space 28 is provided between the upper inclined surface of each key 25 and the undersurface of support bar 27. As may be seen in FIG. 3, this open space 28 is sufficient in size to receive a projection 21 on holding rail 11. As may also be seen, the inclined upper surface of each such support bar key 25 and the inclined wedging surface 20 of each projection 21 are complimentary and cooperate to form an angle of generally about 180°.

The support bar 22 is initially positioned on the holding rail 11 such that each of its projections 24 projects into a corresponding depression 18 in the holding rail 11. The support bar 22 is then shifted horizontally to the right until the wedging face 20 of each of the projections 21 and a corresponding inclined surface 26 of each of the keys 25 achieve frictional fit with each other. The projections 21 on the holding rail 11 are somewhat shorter than the spaces formed by the keys 25 and the under side 23 of the holding rail 11 so that the projections 21 can always project into the spaces 28 in a manner such that their slant faces 20 contact the key surfaces 26 of the keys 25 while an upper side 30 of the projections 21 is simultaneously in contact with the under side 23 of the support bar 22.

The support bar 22 is secured in place on holding rail 11 by a tensioning element in the form of a truncated tapered cone 27. The truncated tapered cone 27 is received at a left end of the groove 2 in a vertical borehole 29 in the plate or blanket cylinder 1. This borehole 29 overcuts the groove 2 at its left end, so that a vertical gap is achieved, through which a left end 32 of the support bar 22, which is inclined to correspond with the inclination angle of the truncated tapered cone 27, protrudes into the borehole 29. The truncated tapered cone 27 has a borehole 34 in its center to accommodate a pressure screw 33. The pressure screw 33 passes down through the borehole 34 and is received in a threaded hole S6 which is formed in the plate or blanket cylinder 1 as an extension of the borehole 29. When the pressure screw 33 is tightened, the truncated tapered cone 27 is moved vertically downwards and its tapered face acts from above upon the slanted face 32 of the support bar 22 so that bar 22 will be shifted horizontally to the right, in the manner that a shiftable bayonet lock is shifted into a keyed position, and retained there. Below the truncated tapered cone 27 and above the threaded hole 36, the pressure screw 33 has a collar 38 which presses up against the bottom of the truncated tapered cone 27, when the pressure screw 33 is being unscrewed, and shifts it out of the keyed position vertically upwards.

To take the support bar 22 out of the cylinder groove 2, bar 22 must be shifted horizontally to the left. A gap 42 is provided at a right end of the cylinder groove between a cylinder wall 41 and a right end of the support bar 22. A levering tool 43 can be introduced into gap 42, as may be seen in FIG. 3, in order to be placed against a point of force application 44 in the support bar 22. When the levering tool 43 is actuated, it stems itself against the cylinder wall 41 and shifts the support bar 22 to the left so that the projections 21 disengage from the spaces 28. The support bar 22 can now be removed vertically from the cylinder groove 2. After removal of the support bar 22, there is sufficient space to allow insertion of the printing plate or blanket ends 8 and 9 into the tensioning devices 3 and 4 without hindrance. After blanket end insertion, the support bar 22 can be re-installed. The support bar 22 protrudes in height out of the groove 3 a sufficient distance that the diameter of the cylinder 1 at this point is equal to the diameter of the cylinder body 1 with printing plate 8 or blanket 9. When applied to blanket cylinders, the support bar 22, protrudes beyond the groove 2. A front face or support surface 39 of the support bar 22, which itself may be manufactured of steel or hard synthetic material, can be covered with a tough-elastic material. The narrow groove gap between the two printing plate or blanket ends 8 and 9 is thus completely filled and covered by the upper or front face 39 of support bar 22.

Figure 4:
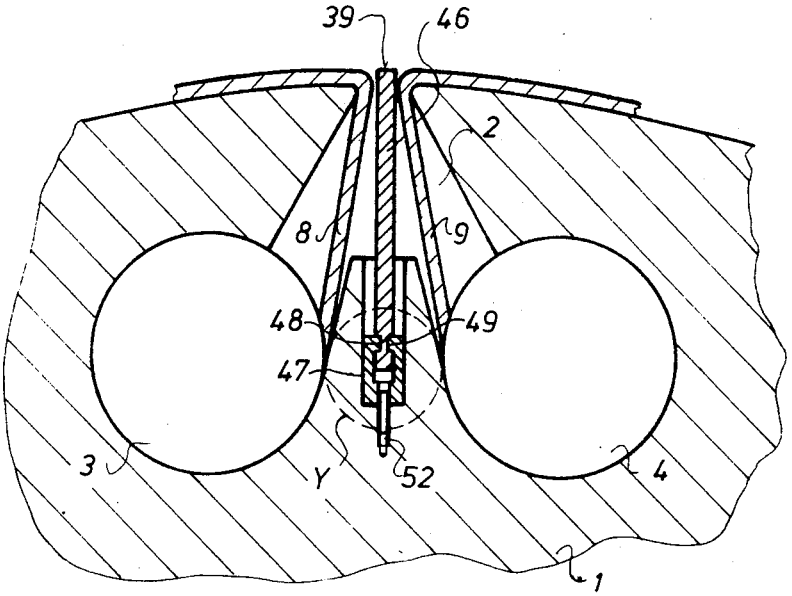
FIG. 4 is a cross-sectional view of a second preferred embodiment of a support assembly in accordance with the present invention.
Figure 5:
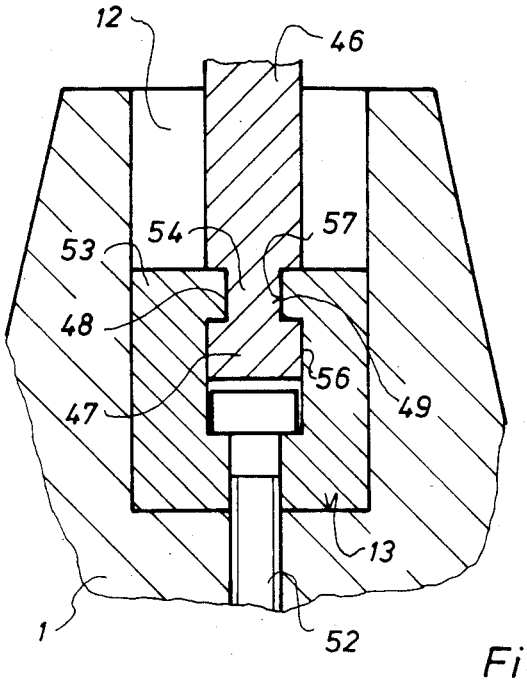
FIG. 5 is an enlarged cross-sectional view of that portion of FIG. 4 encircled at Y in FIG. 4.

A second embodiment of a support assembly for a cylinder groove in accordance with the present invention is shown in FIGS. 4 and 5. In this second embodiment, a support bar 46 is provided which, on a lower or foot part 47, has two parallel, preferably rectangular opposed slots 48 and 49 on opposite sides of foot portion 47. The support bar 46 is inserted into a slot 56, which has a reduced width upper portion 57 and which is secured to the bottom 13 of slot 12 in cylinder groove 2. Slot 56 may be formed in a lengthwise slit profile rail 53 which is fastened to the groove bottom 13 by a plurality of fastening screws 52. Support bar 46 of this second preferred embodiment is held in place by the same truncated tapered cone 27 and associated pressure screw 33 as was discussed with the first preferred embodiment. The profile rail 53 may, for example, have the form of a lengthwise slit rectangular pipe so that a crosspiece piece 54 separating both slots 48 and 49 of support bar 46 will come to rest exactly in the slit 46 of the profile rail 53. It will be understood that support bar 46 of this second preferred embodiment is insertable into slit profile rail 53 from one end face of the plate or blanket cylinder 1.

Figure 6:
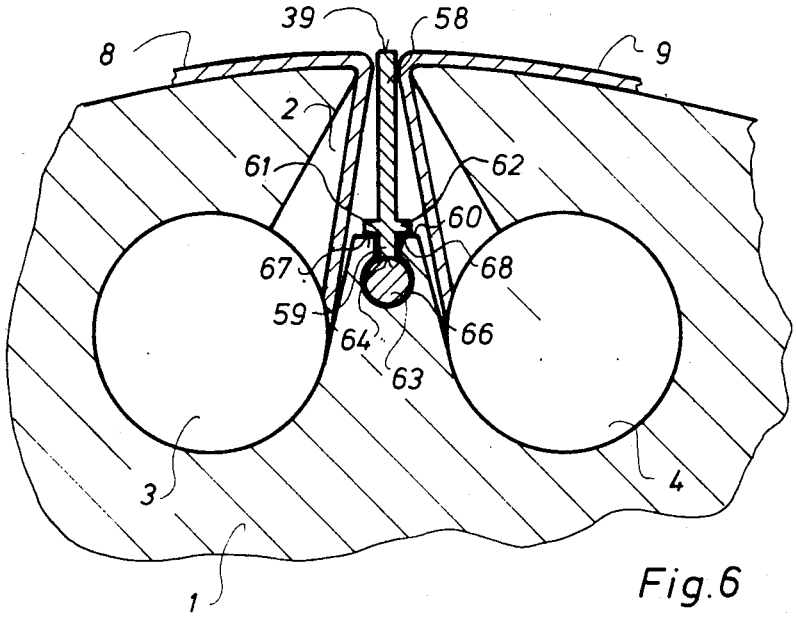
FIG. 6 is a cross-sectional view of a third preferred embodiment of a support assembly in accordance with the present invention.
Figure 7:
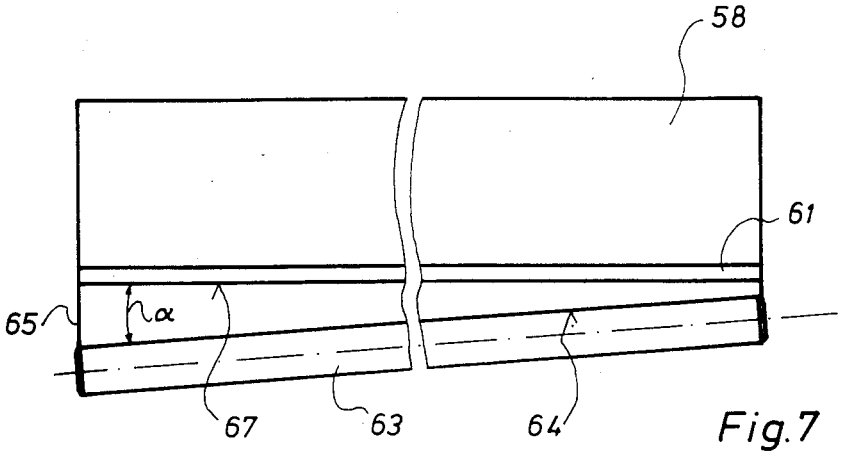
FIG. 7 is a side elevation view of a support bar portion of the third preferred embodiment.

In a third preferred embodiment of a support assembly for a cylinder groove in accordance with the present invention, as may be seen in FIGS. 6 and 7, there is provided a support bar 58. This support bar 58 carries a pair of opposed, generally rectangular, outwardly projecting fins or flanges 61 and 62. These are located generally at a foot portion 59 of support bar 58 and overlie a generally cylindrical rod-shaped body 63 which is welded or otherwise secured to an inclined lower edge 64 of support bar 58. As may be seen in FIG. 7, cylindrical body 63 and under edge 64 of support bar 58 are inclined at an angle$\alpha$ with respect to the generally horizontal opposed fin or flanges 61 and 62. Support bar 58 is inserted from one of the end faces of plate or blanket cylinder 1 into an open top, generally round groove or slot 66 formed in cylinder groove 2. This groove or slot 66 is also inclined at the same angle $\alpha$ to the axis of rotation of cylinder 1. Insertion of support bar 58 is continued until underside portions 67 and 68 of outwardly projecting fins or flanges 61 and 62, respectively lie flat against a bottom portion 60 of cylinder groove 2. Support bar 58 of the third preferred embodiment is held in place again in a manner similar to that discussed with the prior two embodiments, i.e., by truncated tapered cone 27 and pressure screw 33. It is removed using the levering tool 43 in a manner similar to the previously discussed first and second embodiments.

Figure 9:
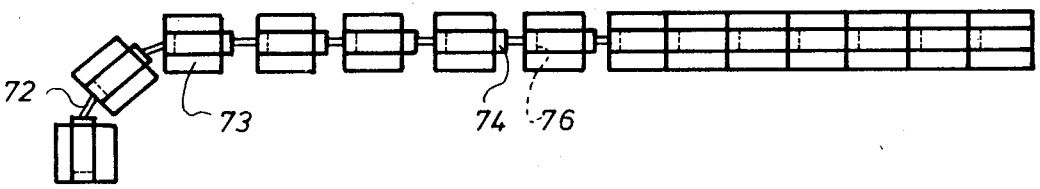
FIG. 9 is a top plan view of the support bar of FIG. 8 and showing a declining end of the bar.

A fourth embodiment of a support assembly for a cylinder groove in accordance with the present invention provides a support bar 71 which may consist of a plurality of individual links 73 that are movably connected to each other by a plurality of connecting rods 72, as may be seen most clearly in FIGS. 8 and 9. Each of the links 73 has a projection 74 on a first vertical face and a cooperatively shaped and positioned recess 76 on a second, opposed vertical face. The links 73 thus interfit, as may be seen in the right side portion of FIG. 8 by insertion of projection 74 of one link 73 into recess 76 of an adjacent link 73. Each link 78 has a hollow lower portion 75 into which the connecting rods 72 may be placed. This allows the links 73 to be pushed together to form a support bar 71 having an uninterrupted upper surface 39.

The chain-like support bar 71 of the fourth preferred embodiment, which consists of the plurality of links 73 and connecting rods 72, can be threaded into a cooperatively shaped slot in the bottom of cylinder groove 2 either in a sideways direction from an end face of cylinder 1 or from above at a cylinder end between a bearer ring 77 and a cylinder surface 78. As with the prior embodiments, this support bar receiving guide slot may be secured directly or indirectly to the cylinder 1 and is generally parallel to the cylinder's axis of rotation.

Figure 10:
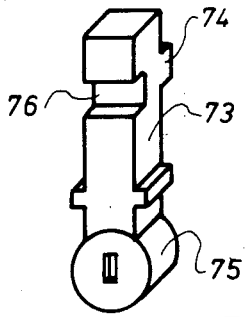
FIG. 10 is a perspective view of a first support bar link usable in the fourth preferred embodiment of the support assembly.
Figure 11:
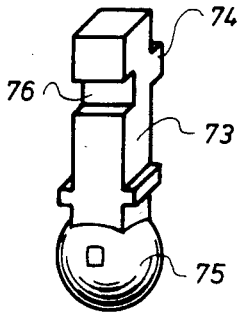
FIG. 11 is a perspective view of a second support bar link.

While the support bar 71 of the fourth preferred embodiment is shown in FIGS. 8 and 9 as a plurality of interconnected links 73 joined by the connecting rods 72, it would also be possible to from support bar 71 from a plurality of individual links 73 not joined by connecting rods 72. In this situation, each individual link would be inserted into the guide slot. Since, as may be seen in FIGS. 10 and 11, each link has spaced opposed fine, in a manner similar to the fins or projections 61 ad 62 of the third preferred embodiment, the individual links 73 will be stable when inserted into a guide slot in groove 2 of the cylinder 1. As may also be seen in FIGS. 10 and 11, the lower hollow body portion 75 of the links 73 may have several different shapes.

Figure 12:
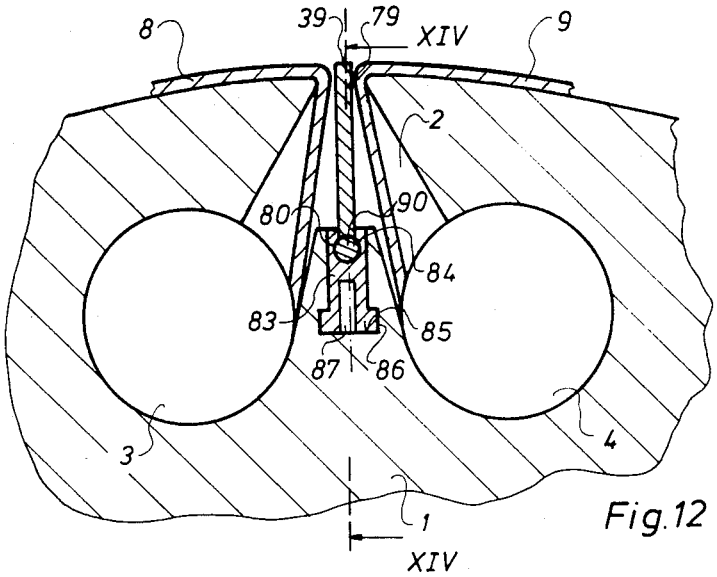
FIG. 12 is a cross-sectional view of a fifth preferred embodiment of a support assembly in accordance with the present invention.
Figure 13:
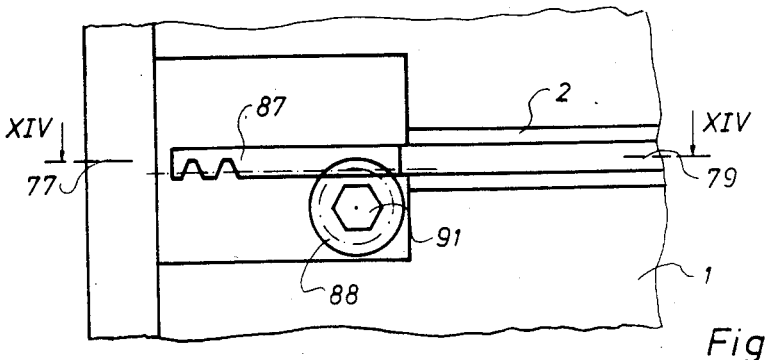
Figure 14:
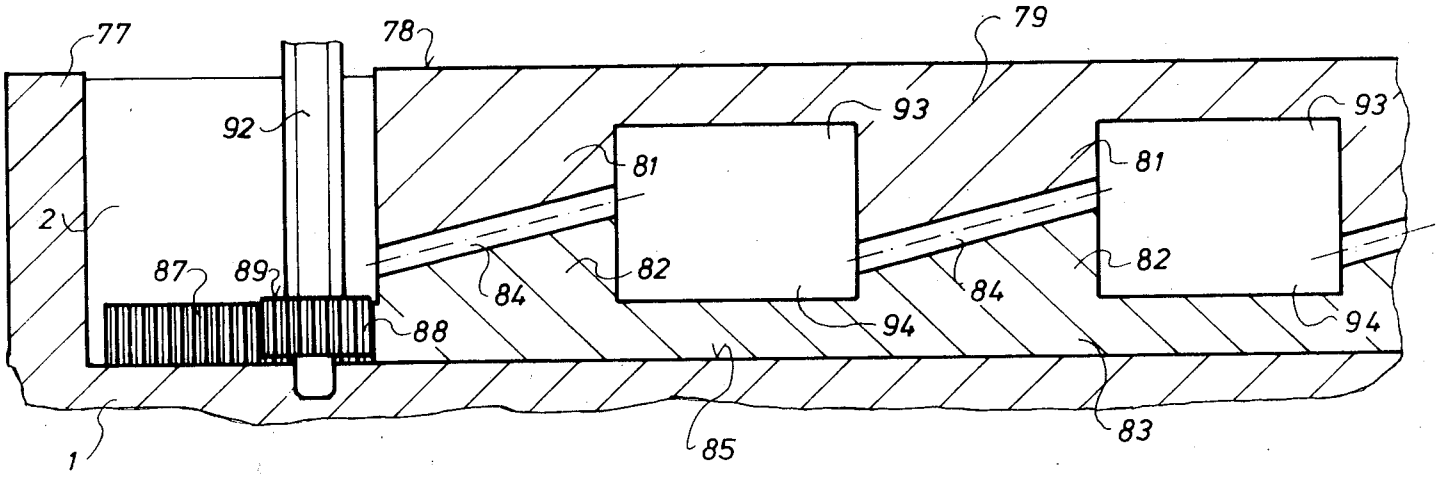
FIG. 14 is a sectional view of the fifth preferred embodiment of the support assembly, taken along line XIV—XIV of FIGS. 12 and 13 is with the adjusting mechanism of the assembly shown unsectioned.

In a fifth preferred embodiment of a support assembly in accordance with the present invention, as may be seen in FIGS. 12, 13 and 14, a support bar 79 is provided which is arranged so as to be vertically adjustable but not horizontally shiftable. The support bar 79 has, distributed over its length, a plurality of comb-like, vertically inclined projections 81. These projections 81 rest flat on a corresponding number of inclined projections 82 which are formed as parts of a horizontally shiftable support rail 83 and which are retained by several guide pieces 84. Each of these guide pieces 84 consists of a round slot 80 which is open at its top, and which is formed on horizontally shiftable support rail 83, and a cooperating cylindrical lower edge 90 of each projection 81 of the support bar 79. The support rail 83 is supported in a longitudinal slot 86 in the bottom 85 of the cylinder groove 2 and is horizontally shiftable but not vertically movable.

The support rail 83 is shaped at one end as a toothed rack 87 and is in tooth engagement with a spur gear 88. The spur gear 88 is rotatably supported in the groove 2 in the cylinder body 1 and has, on a side face 89 directed upwards and arranged parallel to the groove bottom 85, a seat for a tool 92. When the spur wheel 88 is turned in a clockwise direction, the support rail 83 is shifted horizontally to the right. The vertically guided support bar 79 slides, while being guided through the guide piece 84, downwards so that each of the projections 81 comes to lie in intermediate spaces 94 between two projections 82 and the projections 82 come to lie in spaces 93 between two projections 81. In this manner, the support rail 79, depending on the shift path of the support rail 83, can be lowered to a greater or lesser degree so that insertion of the printing plate or blanket ends 8 and 9 is not hindered.

While preferred embodiments of a support assembly for a cylinder groove in accordance with the present invention have been fully and completely described hereinabove, it will be apparent to one of skill in the art that a number of changes in, for example, the size and depth of the cylinder groove, the types of plate and blanket tensioning means, the specific shapes of the cylinder slot bottom, and the like could be made without departing from the true spirit and scope of the subject invention which is accordingly to be limited only by the following claims.

What is claimed is:

1. A support assembly for a cylinder groove of a plate or blanket cylinder in a rotary printing machine, said support assembly comprising:

an elongated support bar positionable in said cylinder groove, said support bar having a support surface;

an elongated slot formed in a bottom portion of said cylinder groove, said elongated slot extending along said cylinder groove generally parallel to the axis of rotation of the cylinder;

means in said slot to removably secure said support bar to said bottom portion of said cylinder groove; and means to locate said support bar longitudinally in said cylinder groove to position said support surface of said support bar generally at the periphery of the plate or blanket cylinder.

2. The support assembly of claim 1 wherein said support bar includes a plurality of spaced downwardly extending projections and further wherein said means to secure said support bar in said groove includes a holding rail secured in said slot, said holding rail including depressions which lockingly receive said projections on said support bar.

3. The support assembly of claim 1 wherein said support bar includes a reduced thickness cross piece which is formed generally at a lower portion of said support bar between parallel opposed support bar slots and further wherein said means to secure said support bar in said groove includes a profile rail in said elongated slot, said profile rail having a reduced width upper portion, said cross piece of said support bar being positionable in such reduced width upper portion.

4. The support assembly of claim 1 wherein said support bar includes a generally cylindrical lower portion which is inclined at an angle $\alpha$ to an upper surface of said support bar and further wherein said elongated slot in said cylinder groove bottom, is inclined at an angle $\alpha$ to the axis of rotation of said cylinder, said cylindrical lower portion of said support bar being positionable in said inclined slot.

5. The support assembly of claim 1 wherein said support bar is formed of a plurality of links which are interconnected connecting rods.

6. The support assembly of claim 5 wherein each of said links has a projection on a first vertical face and a cooperatively shaped recess on a second, opposed vertical face, and further wherein each of said links includes a hollow lower body portion, said connecting rods being receivable in said hollow lower bodies when said links are positioned adjacent each other to form said support bar.

7. The support assembly of claim 1 wherein said support bar includes a plurality of downwardly extending projections, each of which has an inclined lower face and further wherein a horizontally shiftable support rail is supported in said slot in said groove bottom, said horizontally shiftable support rail having a plurality of upwardly inclined projections each of which has an inclined upper face, said faces of said downwardly and upwardly inclined projections being in sliding contact with each other whereby horizontal movement of said support rail causes vertical movement of said support bar.

8. The support assembly of claim 7 wherein said upwardly inclined projections on said support rail and said support bar are slidably interconnected by slanting slide guide means.

9. The support assembly of claim 7 further including means to horizontally shift said support rail.

* * * * *